US005845786A

United States Patent [19]

Brown

[11] Patent Number: 5,845,786

[45] Date of Patent: Dec. 8, 1998

[54] INERTIA-OPERATED CLAMPING DEVICES AND A SHIPPING RACK USING THE SAME

[76] Inventor: Doyle Eugene Brown, 988 Briston, Rochester Hills, Mich. 48307

[21] Appl. No.: 728,544

[22] Filed: Oct. 9, 1996

[51] Int. Cl.[6] ..... A47F 7/00

[52] U.S. Cl. ..... 211/13.1; 100/55.3

[58] Field of Search ..... 211/13.1, 4; 248/680, 248/681, 676; 108/55.1, 55.3

[56] References Cited

U.S. PATENT DOCUMENTS

| | | | |
|---|---|---|---|
| 3,753,407 | 8/1973 | Tilseth | 108/55.3 X |
| 4,718,632 | 1/1988 | Meineke | 248/681 |
| 4,739,206 | 4/1988 | Sieber | 248/676 X |
| 4,869,377 | 9/1989 | Mercado | 211/4 X |
| 4,911,312 | 3/1990 | Jeruzal | 211/4 X |
| 4,991,818 | 2/1991 | Darbo et al. | 248/681 |

FOREIGN PATENT DOCUMENTS

| | | | |
|---|---|---|---|
| 1025210 | 4/1953 | France | 248/681 |
| 2608333 | 9/1977 | Germany | 248/681 |

*Primary Examiner*—Jose V. Chen
*Attorney, Agent, or Firm*—Fitch, Even, Tabin & Flannery

[57] ABSTRACT

A movable storage or carrying rack, or the like and an inertia operable locking or clamping device to clamp articles to the racks during transport of the articles is shown. An inertia-operated clamp that is in a release or ineffective position while the rack is stationary and which locks automatically at a high impulse or acceleration force is provided.

11 Claims, 4 Drawing Sheets

Fig. 7
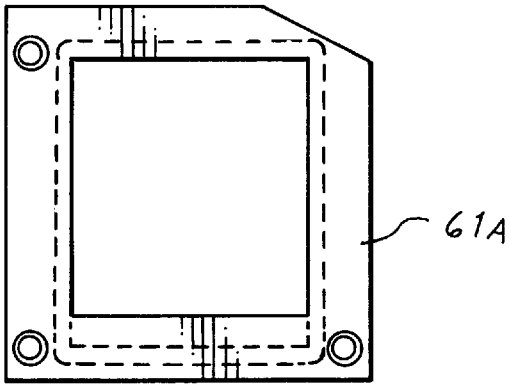
Fig. 8
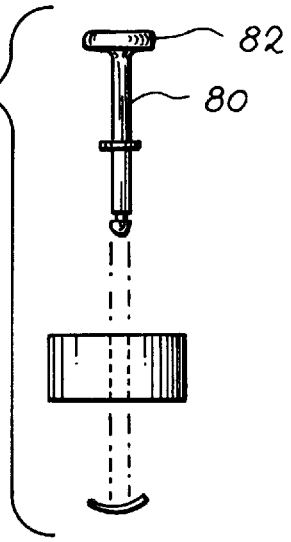
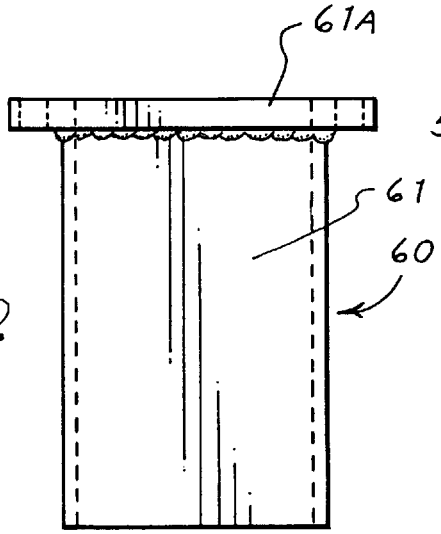
Fig. 12
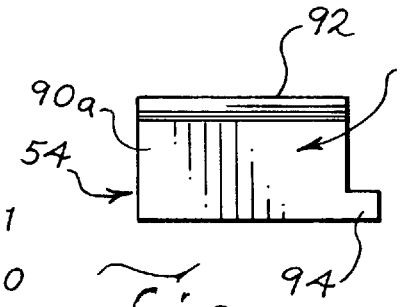
Fig. 9
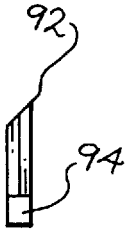
Fig. 10
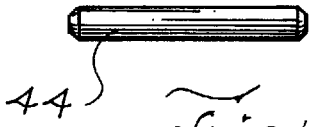
Fig. 11
Fig. 13
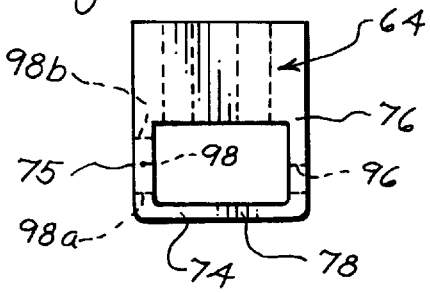
Fig. 14
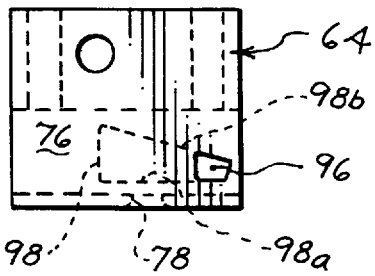

INERTIA-OPERATED CLAMPING DEVICES AND A SHIPPING RACK USING THE SAME

BACKGROUND OF THE INVENTION

This invention relates to movable storage or carrying racks, or the like, and to inertia operable locking or clamping devices to clamp articles to the racks during transport of the articles.

The present invention will be explained in connection with its preferred use, which is to releasably clamp automotive engines to carrying racks therefor; but the present invention is applicable to other storage devices or racks than that described herein and is applicable to articles other than engines. Currently, automotive engines each weighing about 400 pounds are shipped in carrying racks on railroad cars or trucks. In railroad cars, eight motors typically may be mounted in a lower layer of a three-tiered rack with an additional eight motors in each of the upper tiers, resulting in twenty-four motors in total in the rack. It had previously occurred where the engines were not locked or clamped to the racks that some engines would in some instances be knocked off the racks and become damaged. To prevent such damage, the engine racks have been provided with displaceable locking pins that were spring-urged into a locking position with the engine. After positioning the engines on the racks with a crane, a person would grasp a T-shaped handle of each locking pin, and allow the spring to insert the pin into a locking position with the engine. When it is desired to remove the engine from the rack with a crane, a person would again grasp the T-shaped handle and pull the locking pin outwardly. The locking pin had a 45° flat thereon; and the person would twist the pulled pin to retain it outwardly against the urging of the spring.

Typically, the engines have an eye, or hook, on the top of the engine; and a crank hooks this eye on the engine and lifts the engine vertically from the rack. The use of a person to lock and unlock the clamping pins is a cost that is desired to be eliminated. Thus, there is a need for a new and improved, releasably clamping system for such racks, or the like.

SUMMARY OF THE INVENTION

In accordance with the present invention, racks for articles (such as, for example, an engine) are provided with inertia-operated clamping or locking devices which allow the installation and/or removal of the engine from the rack without the use of a person to manually lock or unlock the same. The inertia-operated clamping devices clamp the articles at predetermined impulse loads that would knock an engine from the rack. Often, an impulse force or acceleration large enough to displace or knock the engine from the racks occurs during coupling or uncoupling of a railroad car. For example, the coupling velocity between trains may be at speeds as much as ten (10) miles per hour, and an impulse of about 5 G's for 50 milliseconds. While the manual locking pins have to be set and unset by a person and will resist such impulse loads, the present invention has inertia locks or clamps that are in a release state except for the short periods of high energy impulses so that the engines can be hooked and lifted from or lowered into the rack without a person having to manually release them or lock them. To this end, the present invention provides an inertia-operated clamp that is in a release or ineffective position while the railroad car rack, is stationary and which locks automatically at a high impulse or acceleration force that would tend to knock the engine off the rack, if it were not clamped thereto.

In accordance with the preferred embodiment of the invention, the engine rack is provided with pivoted clamps that are weighted to pivot to an open position to allow the dropping of the engine block on the rack. The engine engages the clamp and shifts it to a clamping position with the engine. With a lifting of the engine, a portion of the engine cams the clamp to pivot to its open position so that the engine can be removed without someone manually operating the clamp. An inertia actuator in the clamping device is shifted by an inertia member, or weight, to lock the clamping device in its clamping position to prevent the engine from being lifted upwardly or twisted from its cradle seat in the rack. Typically, the impulse energy from a 10 mph coupling velocity will be in the range of 3–5 G's for 50 milliseconds or less in duration. Typically, each engine will have diagonally opposite corners provided with inertia-operated clamps such that there are forty-eight inertia clamps for the twenty-four engines on a rack.

BRIEF DESCRIPTION OF THE DRAWINGS

FIG. 7 is a plan view of a lower frame member of the clamping device;

FIG. 8 is an exploded view of a pendulum inertia weight;

FIG. 9 is an elevational view of a blocking member;

FIG. 10 is an end view of the blocking member of FIG. 9;

FIG. 11 is an elevational view of a pivot pin;

FIG. 12 is a side elevational view of the frame member shown in FIG. 7;

FIG. 13 is a front elevational view of an inertia block body;

FIG. 14 is a side elevational view of the inertia block body shown in FIG. 13;

DETAILED DESCRIPTION OF THE PREFERRED EMBODIMENT

Figure 1:
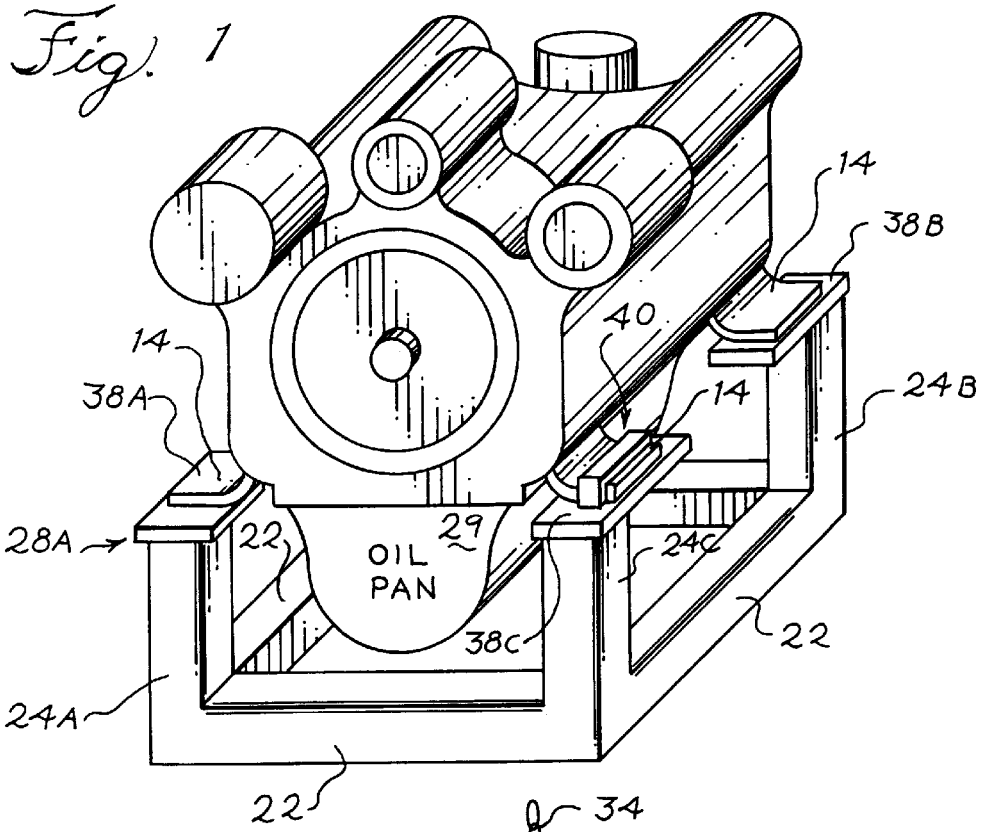
FIG. 1 is a perspective view of an engine mounted in an engine stand and secured thereto with clamping devices and embodying the invention.

As shown in the drawings, for purposes of illustration, the invention is embodied in a stand 10 with a plurality of such stands are secured together and form a large frame or rack for carrying a plurality of articles such as engines. Typically, the engine is provided with four lugs or feet 14 in the form of horizontally-extending flanges 16 that are integral with the engine block and that rest on support surfaces 18 on the rack. The rack may take various shapes or forms depending on the articles stored or the mode of transportation for the rack. The illustrated stand is formed with a tubular open framework 20 having horizontal cross-beams 22 joined to four upstanding posts 24. The posts have support surfaces 18 in the form of horizontal plates or pads 28 fixed to each of four posts 24 for each engine. The engine is seated or cradled in the rack with an oil pan 29 located in a hollow, central interior of the rack. Typically, for railroad cars, the rack may have three layers or tiers with each layer having eight stands 10 for supporting twenty-four engines in total in a rack. The stands are quite sturdy because the engine typically weighs at least 400 pounds.

The engines 12 are lifted from the stands 10 by means of a crane, which has a chain 34 with a hook to hook 30 (FIG. 2) into an eye 32 at the center of the engine. Conversely, the crane lowers a hooked engine downwardly into a stand, and then the crane hook is detached from the eye on the engine. Heretofore, the engines 12 were locked into the stands by locking pins that were manually inserted over the engine lugs 14 to lock the engine to a stand during transport of the stand and engine. Once the destination was reached, and a crane was available to unload the engines, a person would manually pull the pins from their overlying position, thereby releasing the engines for lifting by the crane. Such an insertion of and a subsequent removal of the locking pin was done by a person at the point of origination, and a second person at the point of destination.

Figure 2:
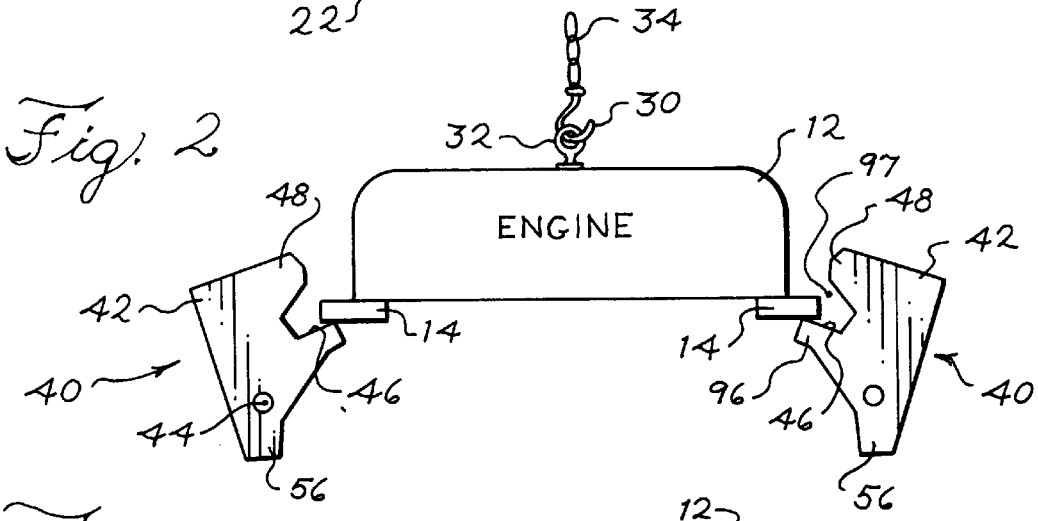
FIG. 2 is a view of an engine on the stand with the clamping device in an open position to receive the engine.
Figure 3:
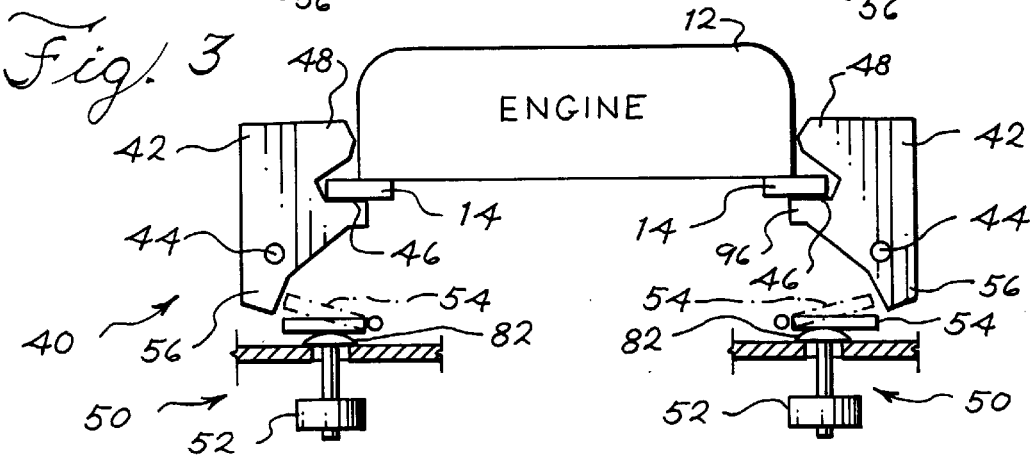
FIG. 3 is a diagrammatic view of an engine being lowered onto the open clamping devices.

In accordance with the present invention, inertia-operated clamping devices 40 are provided on the stand 10 to clamp the engine to the stand when a predetermined energy force is applied to the stand. That is, the engines are generally free to be lifted from or lowered onto the stand without a person locking or unlocking the inertia-operated clamping devices. As best in FIG. 2, the inertia clamping device 40 is generally in open position to receive the engine lugs 14, which are being lowered to rest on the pads 28 of the stand 10. The clamping members 42 are preferably weighted to pivot about a pivot pin 44 to the open position, as shown in FIG. 2. When the lugs 14 hit surfaces 46 on the clamping members during the lowering of the engine, the lugs exert a force on the surfaces to pivot the clamping members from the open position of FIG. 2 to the clamping position, such as shown in FIG. 3, wherein a clamping or locking portion 48 of the clamping member overlies the lug 48. The engine is not locked or clamped in the position of FIG. 3 until the inertia-operated device 40 is operated such as by pivoting an inertia pendulum weight 52 to shift a blocking member 54 to a blocking position with respect to the clamping member 42. In the illustrated embodiment of the invention, blocking member 54 is raised from the solid line, non-blocking position to the dotted line, blocking position (FIG. 3) in front of a portion 56 of the clamping member to prevent the clamping member 42 from pivoting from the clamping position of FIG. 3 to the open release position of FIG. 2. Because an engine will be lowered onto the clamping devices or lifted from the clamping devices while the stand 10 is stationary and the inertia device is inoperative, the engines may be installed on or removed from the rack without a person having to unlock or lock the clamping devices. The inertia devices are settable to lock upon an acceleration force of a predetermined magnitude, e.g. 0.9 G, in this instance, which occurs while the rack is being transported.

It has been found that the engines 12 will be at rest in their stands 10 until a sudden acceleration or deceleration force is applied to the stands of sufficient magnitude to cause the engine 12 to shift or lock relative to the stand. Often, the energy pulses are very short in time duration, e.g., about 35 to 50 milliseconds; and the energy pulse dissipates thereafter so that the engine need not be locked or clamped to the stand. One example of such an energy pulse occurs when railroad cars carrying a rack suddenly are jolted by being coupled together at velocities in excess of 5 mph or approximately 2.5 G's are sustained for 30 to 50 milliseconds. In tractor trailers, a sudden braking could cause an energy pulse that could dislocate an unclamped engine if it were not clamped to its stand. The illustrated inertia energy devices are activated at about 0.9 G and provide stability to engine through the approximately 35 to 55 milliseconds of acceleration that may reach about 2.5 G's.

It has been found that two inertia-operated clamping devices 40 at diagonally opposite corners (FIG. 1) are sufficient and that there need not be any clamping devices at the other corners.

Figure 1A:
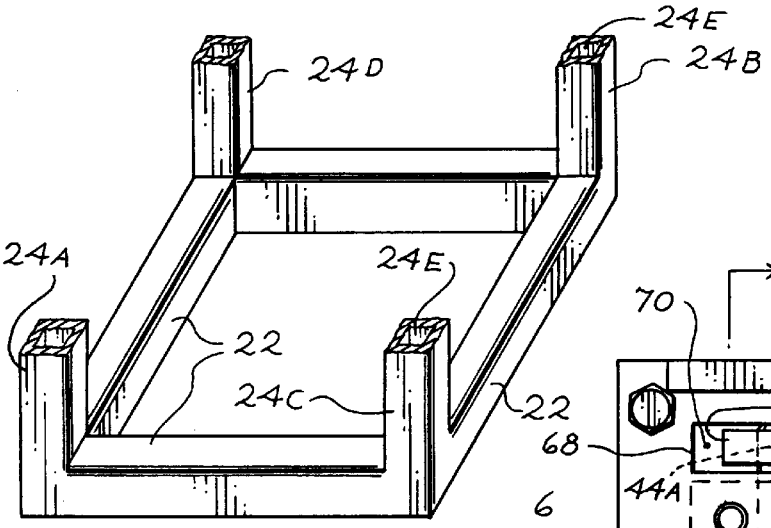
FIG. 1A is a partial, schematic view of the stand.

As illustrated in FIG. 1, pads 28A and 28B do not have a clamping device 40 thereon, but merely have a flat, horizontal plate 28A and 28B on the top end of the diagonal opposite posts 24A and 24B. The lugs resting on these corner posts 24A and 24B are not clamped. The corner posts 24C and 24D (FIGS. 1 and 1A) are each provided with an inertia-operated clamping device 40 having a flat top plate 38C on which will be seated an engine lug 14. Manifestly, the number of inertia clamping devices may be decreased or increased from two and fall within the purview of the invention.

Figure 4:
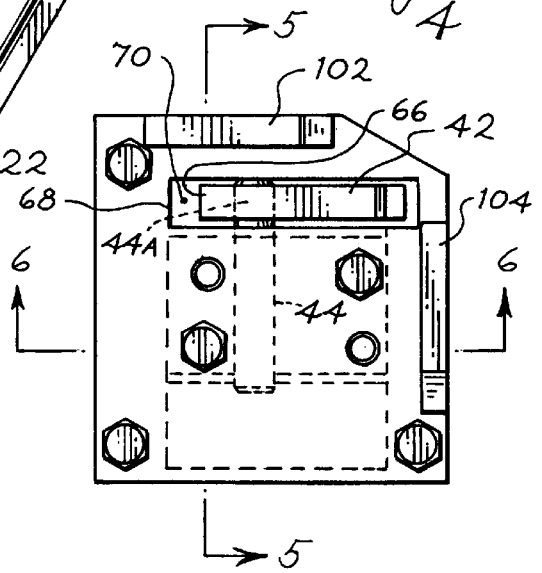
FIG. 4 is a plan view of the clamping device constructed in accordance with the preferred embodiment of the invention.
Figure 5:
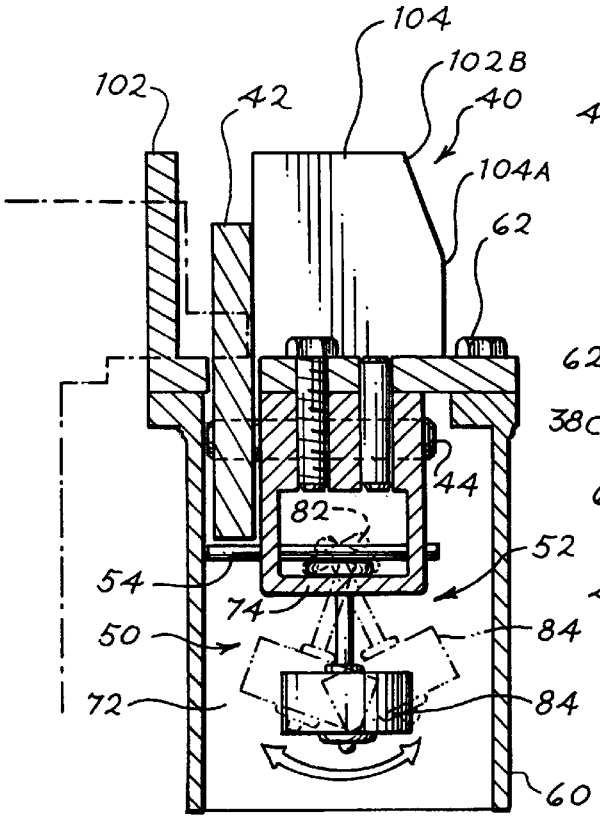
FIG. 5 is a cross-sectional view taken along the line 5—5 of FIG. 4.
Figure 6:
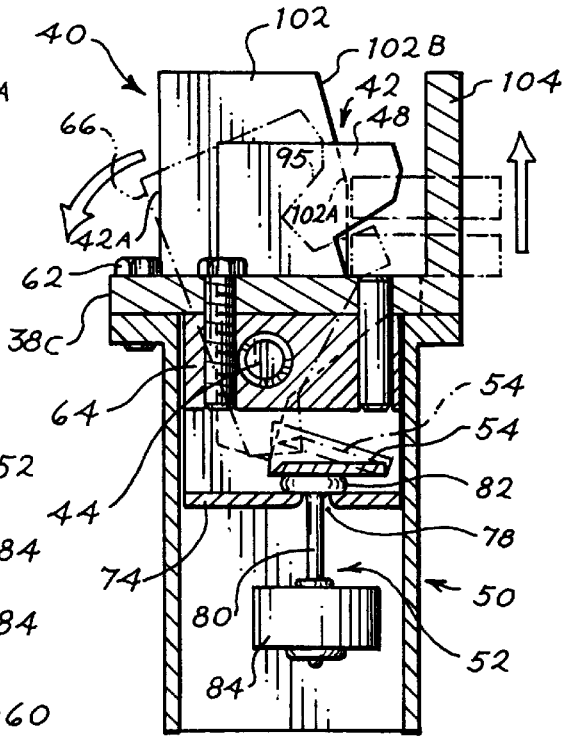
FIG. 6 is a cross-sectional view taken along the line 6—6 of FIG. 4.
Figure 16:
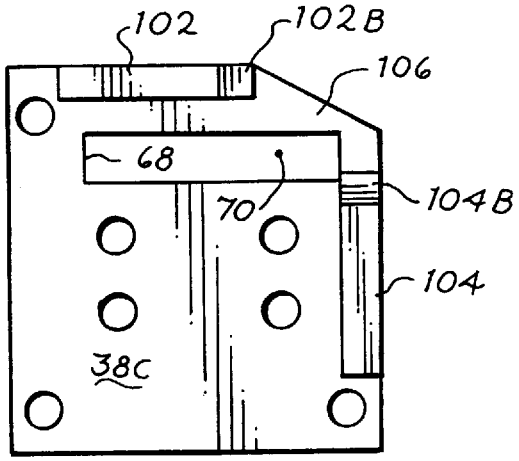
FIG. 16 is a plan view of an upper frame member of the inertia clamping device.
Figure 17:
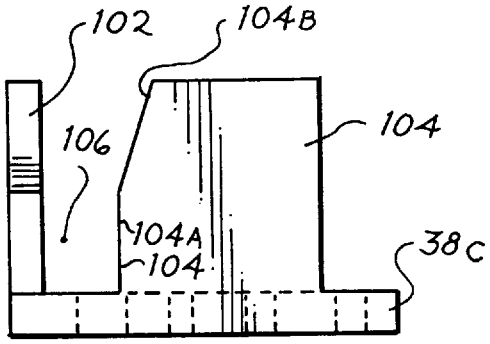
FIG. 17 is a front elevational view of the upper frame member.
Figure 18:
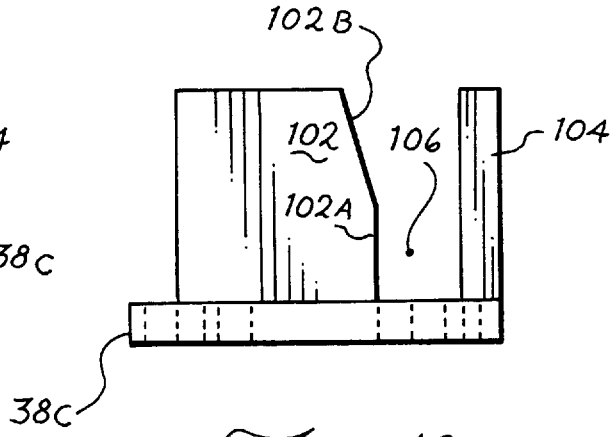
FIG. 18 is a side elevational view of an upper frame member.
Figure 15:
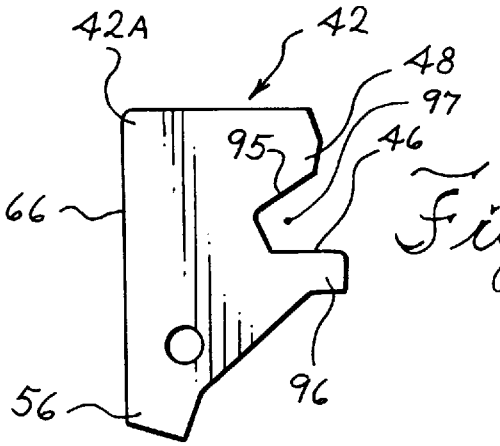
FIG. 15 is a side elevational view of a clamping member.

Referring now in greater detail to the illustrated embodiment of the inertia-operated, clamping device 40, it includes a frame 60 (FIG. 12) that is tubular in shape with a hollow, lower tubular portion 61 that is sized to slide down into the hollow interior bore 24E of the corner posts of the stands. An encircling flange 61A on the top end of the tubular portion 61 projects horizontally and will rest on the top end walls of the corner posts 24D and 24E. The plate 38C that supports the engine lugs is fastened to the top sidewall of the flange 61A by bolts 62, as best seen in FIGS. 5 and 6. The horizontal plate 38C has secured thereto an underlying block body 64 that carries the pivot pin 44. One end 44*a* (FIG. 11) of the pivot pin 44 supports the clamping member 42 for rotation about the longitudinal axis of the pivot pin. The pivoting motion in the opening counterclockwise direction of FIG. 6 is stopped when rear, vertical side 66 abuts end wall 68 (FIGS. 4 and 16) in a slot 70 in the horizontal frame plate 38C. The clamping member is mounted in the slot 70 by the pivot pin 44 with an upper portion 42A located above the plate 62, and a lower portion 56 of the clamping member 42 below the plate 38C.

The illustrated frame 60 is tubular in shape with a hollow interior chamber or bore 72 within which is mounted the inertia device 52. The illustrated inertia device comprises a pendulum support plate 74 that is horizontally disposed in a hollow bottom portion of the block body 64, as best seen in FIGS. 5, 6, 13 and 14. A pair of vertical sidewalls 75 and 76 depend from the upper solid portion of the block body 64 to support the pendulum support plate 74 which has an aperture 78 therein (FIGS. 5, 6, 13 and 14). A stem shaft 80 of the inertia weight 52 extends through the aperture 78 with an enlarged head 82 of inertia weight resting on the top of the support plate 74. A cylindrical weight 84 (FIG. 8) is fastened to the lower end of the shaft by a spring washer fastener 86. An inertia force of 0.9 G or greater will cause the weight to pivot, as shown in dotted lines in FIG. 5, to cause the head 82 to pivot on an edge and lift the opposite edge to pivot upwardly the blocking member 54 from its lower, ineffective position to its upper blocking position, shown in dotted lines in FIGS. 2, 3 and 6. In the blocking position, the blocking member 54 will be abutted by the clamping member's lower portion 56 trying to swing counterclockwise under the urging of the engine lug 14 that is trying to rise and free itself from the clamping device.

The illustrated blocking member 54 is in the form of a lever or pawl 90 (FIGS. 9 and 10) and in the shape of a small, flat plate 90 having a sharpened edge 92 that will engage and abut the lower portion 56 of the clamping member. A small, end pivot tang or lug 94 on the plate 90 is fitted into a pivot hole or opening 96 (FIGS. 13 and 14) in wall 76 of the block-shaped body 64. A wider opening 98 is formed in the opposite wall 75 of the body with opposite end 90*a* (FIG. 9) of the plate 90 being disposed to pivot from a lower, horizontal position in which the plate 90 rests on a bottom side 98*a* (FIG. 14) of the opening 98. When the plate 90 is pivoted upwardly by head 82 of the inertia weight, the upward pivoting motion about the ends plate 94 and 90*a* is stopped when the upper side of the plate abuts upper inclined side 98*b* of opening 98 (FIGS. 13 and 14).

When the engine is lifted by the hook and eye, the top outer edge of the lugs 14 on the engine 12 abuts an inclined camming surface 95 on the locking portion 48 of the clamping member 42 to pivot it counterclockwise (FIGS. 2 and 3) about the pivot pin 44 to be in open release position. When the lugs 14 are lowered, they abut the contact surfaces 46 on fingers 96. The lugs 18 are disposed in the gap or slot 97 between the locking portion 48 and the finger 96 on the clamping member 42.

The upper part of the frame of the locking device 40 that receives the engine lug 18 is preferably formed with a pair of upstanding guide rails 102 and 104 projecting upwardly from the plate 38C for guiding the engine lugs 14 to lower into a vertical slot 106 therebetween. To this end, vertical sides 102A and 104A of the guide rails are formed with upper inclined walls 102B and 104B which engage an engine lug 18 and center it therebetween to prevent the lug from sliding in either of two directions across the plate 38C.

From the foregoing, it will be seen that there is a new and improved apparatus for clamping articles, such as engines, to movable racks at the time that a large acceleration or deceleration force is being applied to the rack that would dislodge the articles if they were not clamped to the rack. The preferred inertia-operated devices allow article removal from the rack or article placement on the rack, as if no clamping device were present, since one does not need to operate any clamps or locking devices to permit the lifting of articles from the rack or lowering of articles onto the rack. The inertia clamping devices are relatively simple and inexpensive, yet highly functional. Preferably, the inertia-operated devices are made of stainless steel or other corrosion-resistant materials because they may be exposed to the weather elements for long periods of time; and it is desired that they continue operating without substantial maintenance even after such exposure.

While the present invention discloses a pendulum kind of inertia weight, it is to be understood that other kinds of inertia weights such as balls or toppling upright weights (sometimes called "standing man" weights) could be substituted for the pendulum weight. While the preferred clamping member is a single piece from a cost standpoint, it is to be understood that the clamping member could be made of several pieces and still fall within the purview of the invention, as described in the appended claims.

What Is claimed Is:

1. A rack for releasably clamping articles thereto and for allowing vertical lifting of articles from or lowering of articles into a rack, said rack comprising:

a frame for holding a plurality of articles thereon;

a plurality of releasable clamping devices on the rack for releasably locking articles on the rack;

a pivoted clamping member on the clamping device engageable by the upward lifting of an article and moved thereby to an open, release position to allow removal of an article from the rack;

an actuator of the clamping member engaged by a lowering of an article to actuate the clamping member to a locking position in which the clamping device retains the article on the rack; and an inertia device connected to the clamping device and operable upon an acceleration or deceleration force of a predetermined magnitude to prevent the clamping member from moving from its clamping position to its open, release position to prevent articles from being knocked off the rack.

2. A storage rack in accordance with claim 1 wherein a frame is provided for the clamping device;

the clamping member is pivotally mounted at a pivot point on the frame; and the clamping member is weighted to pivot about the pivot point to an open position.

3. A storage rack in accordance with claim 2 wherein the actuator for the clamping member comprises an engageable surface on the clamping member to be abutted by an article being lowered onto the rack;

a clamping portion of the clamping member overlies and is spaced from the engageable surface;

such that an article abutting the engageable surface pivots the clamping member and positions the clamping portion over a portion of the article.

4. A storage rack in accordance with claim 1 wherein a frame is provided for the clamping device, the inertia device is mounted to the frame and comprises an inertia weight mounted for movement relative to the frame from an at-rest position to an actuating position; and a blocking member mounted to the frame and actuated by the inertia weight moving to its actuating position to block the clamping member from moving to its open release position.

5. A rack in accordance with claim 4 wherein the inertia weight comprises a pivoted inertial weight, and the blocking member comprises a pivoted blocking lever movable by the inertia weight to swing to a blocking position to abut the clamping member when the inertia weight pivots and actuates the pivoted blocking lever.

6. A rack in accordance with claim 1 wherein the rack comprises a plurality of tiers; and a plurality of engines are mounted in each tier with each engine being retained on the rack by a plurality of clamping devices each having an inertia device.

7. A rack in accordance with claim 1 wherein a pair of diagonally positioned clamping devices are positioned on the rack to engage diagonally opposite corners of an article.

8. A rack in accordance with claim 7 wherein a flange on an article being lowered abuts the clamping member and pivots it to its clamping position; and a camming surface on the clamping member is abutted by an article being lifted from the rack, and the clamping member is pivoted to its open release position.

9. An inertia-operated clamping device for clamping articles upon a predetermined acceleration being applied to the clamping device, said clamping device comprising:

a pivoted clamping member on the frame engageable by the upward lifting of an article and moved thereby to an open, release position to allow removal of an article;

an engaging surface on the clamping member engaged by a lowering of an article onto the clamping device to move the clamping member from the release position to a locking position to retain an article on the clamping device; and an inertia device mounted on the frame and operable upon an acceleration or deceleration force of a predetermined magnitude to prevent the clamping member from moving from its clamping position to its open, release position to prevent an article from being removed from the clamping device.

10. A clamping device in accordance with claim 9 wherein:

the inertia device comprises an inertia weight movable from an at-rest position to an actuating position upon occurrence of the predetermined acceleration or deceleration; and a pivoted blocking lever in the inertia device operable to be pivoted by the inertia weight to a blocking position to block pivoting of the clamping member to its release position.

11. A clamping device in accordance with claim 10 wherein the clamping member has an upper finger portion for pivoting to overlie and to clamp a portion of an article to prevent the removal of the article, when the clamping member is blocked from pivoting, to the open release position by the blocking lever.

* * * * *